US011598336B2

(12) United States Patent
Stephens et al.

(10) Patent No.: US 11,598,336 B2
(45) Date of Patent: Mar. 7, 2023

(54) METHOD OF MAKING A TWO-PIECE COUNTERWEIGHT FOR A SCROLL COMPRESSOR

(71) Applicants: Carl F. Stephens, Liverpool, NY (US); Lauren A. Markley, Chittenango, NY (US)

(72) Inventors: Carl F. Stephens, Liverpool, NY (US); Lauren A. Markley, Chittenango, NY (US)

(73) Assignee: BITZER Kuehlmaschinenbau GmbH, Sindelfingen (DE)

( * ) Notice: Subject to any disclaimer, the term of this patent is extended or adjusted under 35 U.S.C. 154(b) by 320 days.

(21) Appl. No.: 16/887,745

(22) Filed: May 29, 2020

(65) Prior Publication Data

US 2020/0291940 A1 Sep. 17, 2020

Related U.S. Application Data

(63) Continuation of application No. 15/064,408, filed on Mar. 8, 2016, now Pat. No. 10,697,454.

(51) Int. Cl.
*F04C 18/02* (2006.01)
*F04C 29/00* (2006.01)
(Continued)

(52) U.S. Cl.
CPC ..... *F04C 18/0215* (2013.01); *F04C 23/008* (2013.01); *F04C 29/0085* (2013.01);
(Continued)

(58) Field of Classification Search
CPC ..... F04C 18/0215; F04C 29/0085; F04C 29/0021; F04C 23/008; F04C 2210/26;
(Continued)

(56) References Cited

U.S. PATENT DOCUMENTS 3,965,382 A 6/1976 Crosky et al.
4,893,044 A 1/1990 Bush et al.
(Continued)

FOREIGN PATENT DOCUMENTS

JP 59110887 A * 12/1982 ..... F01C 21/003
KR 10-2009-0113242 A 10/2009

OTHER PUBLICATIONS

English translation of JP-59110887 by JPiatPat, May 23, 2022.*

*Primary Examiner* — Deming Wan
(74) *Attorney, Agent, or Firm* — Reinhart Boerner Van Deuren P.C.

(57) ABSTRACT

A method of manufacturing a two-piece counterweight for a scroll compressor is provided. The method includes molding an outer plate, and molding a base having a first opening configured to receive a scroll compressor drive shaft having a longitudinal axis. The method further includes configuring the base for assembly and attachment to the drive shaft. The method also includes attaching the outer plate to the base such that the outer plate is axially offset from the base. In a particular embodiment of this method, the base and outer plate are molded from powdered metal. In certain embodiments, the base and outer plate include one or more openings aligned to permit attachment by inserting a mechanical fastener through the aligned openings. In alternate embodiments, the base and outer plate are attached via brazing or welding.

16 Claims, 11 Drawing Sheets

(51) Int. Cl.
*F04C 23/00* (2006.01)
*F16F 15/28* (2006.01)
*F01C 21/00* (2006.01)

(52) U.S. Cl.
CPC ..... *F04C 2210/26* (2013.01); *F04C 2230/20* (2013.01); *F04C 2230/60* (2013.01); *F04C 2240/40* (2013.01); *F04C 2240/807* (2013.01)

(58) Field of Classification Search
CPC .... F16F 15/28; F16F 2230/32; F16F 2230/20; F01C 21/003
USPC ..... 29/888
See application file for complete search history.

(56) References Cited

U.S. PATENT DOCUMENTS 5,386,163 A * 1/1995 Heilman ..... F16F 15/322 464/180
6,135,727 A 10/2000 Dreiman et al.
6,171,084 B1 1/2001 Wallis et al.
6,291,920 B1 9/2001 Miller et al.
6,305,914 B1 10/2001 Lifson
6,398,530 B1 6/2002 Hasemann
6,428,292 B1 8/2002 Wallis et al.
6,582,211 B2 6/2003 Wallis et al.
6,814,551 B2 11/2004 Kammhoff et al.
6,860,729 B2 3/2005 Sowa et al.
6,960,070 B2 11/2005 Kammhoff et al.
7,112,046 B2 9/2006 Kammhoff et al.
7,967,581 B2 6/2011 Beagle et al.
7,997,877 B2 8/2011 Beagle et al.
8,672,654 B2 3/2014 Beagle et al.
8,764,416 B2 7/2014 Watanabe
9,909,586 B2 3/2018 Duppert
10,233,927 B2 3/2019 Wang et al.
10,697,454 B2 * 6/2020 Stephens ..... F04C 18/0215
2006/0133944 A1 6/2006 Doepker et al.
2013/0251577 A1 9/2013 Bush et al.

* cited by examiner

METHOD OF MAKING A TWO-PIECE COUNTERWEIGHT FOR A SCROLL COMPRESSOR

CROSS-REFERENCE TO RELATED PATENT APPLICATION

This patent application is a continuation of co-pending U.S. patent application Ser. No. 15/064,408, filed Mar. 8, 2016, the entire teachings and disclosure of which are incorporated herein by reference thereto.

FIELD OF THE INVENTION

This invention generally relates to scroll compressors, the parts therefor, and a method of making same.

BACKGROUND OF THE INVENTION

A scroll compressor is a certain type of compressor that is used to compress refrigerant for such applications as refrigeration, air conditioning, industrial cooling and freezer applications, and/or other applications where compressed fluid may be used. Such prior scroll compressors are known, for example, as exemplified in U.S. Pat. No. 6,398,530 to Hasemann; U.S. Pat. No. 6,814,551, to Kammhoff et al.; U.S. Pat. No. 6,960,070 to Kammhoff et al.; U.S. Pat. No. 7,112,046 to Kammhoff et al.; and U.S. Pat. No. 7,997,877, to Beagle et al., all of which are assigned to a Bitzer entity closely related to the present assignee. As the present disclosure pertains to improvements that can be implemented in these or other scroll compressor designs, the disclosures of U.S. Pat. Nos. 6,398,530, 7,112,046, 6,814,551, and 6,960,070 are hereby incorporated by reference in their entirety's.

Additionally, particular embodiments of scroll compressors are disclosed in U.S. Pat. No. 6,582,211 to Wallis et al., U.S. Pat. No. 6,428,292 to Wallis et al., and U.S. Pat. No. 6,171,084 to Wallis et al., the teachings and disclosures of which are hereby incorporated by reference in their entirety's.

As is exemplified by these patents, scroll compressors conventionally include an outer housing having a scroll compressor contained therein. A scroll compressor includes first and second scroll compressor members. A first compressor member is typically arranged stationary and fixed in the outer housing. A second scroll compressor member is movable relative to the first scroll compressor member in order to compress refrigerant between respective scroll ribs which rise above the respective bases and engage in one another. Conventionally the movable scroll compressor member is driven about an orbital path about a central axis for the purpose of compressing refrigerant. An appropriate drive unit, typically an electric motor, is usually provided within the same housing to drive the movable scroll member.

In such scroll compressor assemblies and other such equipment, counterweights are often employed to counteract the weight imbalance about the rotational axis. For example, in scroll compressors, the movable scroll compressor body and the offset eccentric section on the drive shaft create weight imbalance relative to the rotational axis. As a result, a counterweight is often provided for balancing purposes to reduce vibration and noise of the overall assembly via the internal balancing and/or canceling out of inertial forces.

In order to support the development of lighter, less expensive scroll compressors, the machines have become more compact. As scroll compressor have been made more compact, there is less space between components. As such, there is a need in the art for a low-cost counterweight having a complex shape capable of fitting into tight spaces between the electric drive unit and the upper bearing member.

Embodiments of the invention provide such a low-cost counterweight. These and other advantages of the invention, as well as additional inventive features, will be apparent from the description of the invention provided herein.

BRIEF SUMMARY OF THE INVENTION

In one aspect, embodiments of the invention provide a method of manufacturing a two-piece counterweight for a scroll compressor is provided. The method includes molding an outer plate, and molding a base having a first opening configured to receive a scroll compressor drive shaft having a longitudinal axis, and configuring the base for assembly and attachment to the drive shaft. The method also includes attaching the outer plate to the base such that the outer plate is axially offset from the base. In a particular embodiment of this method, the base and outer plate are molded from powdered metal. In certain embodiments, the base and outer plate include one or more openings aligned to permit attachment by inserting a mechanical fastener through the aligned openings. In alternate embodiments, the base and outer plate are attached via brazing or welding.

In a particular embodiment, each of the one or more second openings in the base is threaded, or each of the one or more openings in the outer plate is threaded. In some embodiments, the method includes molding the base, which may be a powdered metal base, having a central hub portion configured to completely encircle the drive shaft, and a perimeter portion located radially outward, with respect to the longitudinal axis of the drive shaft when the base is assembled to the drive shaft, from the central hub portion. The perimeter portion only partially encircles the drive shaft. The one or more second openings are located in the perimeter portion.

In a further embodiment, the method includes molding the outer plate, which may be a powdered metal outer plate, with an inner radial portion and an outer radial portion disposed radially outward, with respect to the longitudinal axis of the drive shaft when the base is assembled to the drive shaft, from the inner radial portion. The one or more outer plate openings are located in the inner radial portion which abuts the base perimeter portion. In a more particular embodiment, the method requires molding the powdered metal base having an arcuate base perimeter portion having a first axial thickness, with respect to the longitudinal axis of the drive shaft when the base is assembled to the drive shaft, and having the central hub portion with a second axial thickness that is less than the first axial thickness such that there is a step at an interface of the perimeter portion and central hub portion.

The aforementioned method may include molding the powdered metal outer plate with an arcuate inner radial portion that includes a stepped portion configured to abut the step on the base to help position the outer plate with respect to the base. In certain embodiments, the method calls for configuring the base and the outer plate such that the step and the stepped portion are arcuate.

In a particular embodiment, the method requires molding the base, which may be a powdered metal base, such that a stepped segment extends axially, with respect to the longitudinal axis of the drive shaft when the base is assembled to the drive shaft, from the perimeter portion of the base, the stepped segment having a first straight radially-inward-facing surface. This method also requires molding the outer plate, which may be a powdered metal outer plate, such that the inner radial portion of the outer plate has a notched segment with a first straight radially-outward-facing surface that abuts the first straight radially-inward-facing surface to help position the outer plate with respect to the base.

In some embodiments, the method involves molding the powdered metal base such that the stepped segment has a second straight surface perpendicular to the first straight radially-inward-facing surface, the second straight surface facing the direction of rotation for the counterweight, and comprises molding the powdered metal outer plate such that the notched segment has a second straight surface perpendicular to the first straight radially-outward-facing surface, the second straight surface abutting the second straight radially-inward-facing surface.

The method may also include molding the powdered metal base such that a first stepped segment extends axially, with respect to the longitudinal axis of the drive shaft when the base is assembled to the drive shaft, from the perimeter portion of the base, the first stepped segment having a first straight radially-inward-facing surface, and such that a second stepped segment, separate from the first stepped segment, also extends axially from the perimeter portion, the second stepped segment having a second straight surface oriented at a right angle with respect to the orientation of the first straight radially-inward-facing surface. This embodiment also calls for molding the powdered metal outer plate, such that the inner radial portion of the outer plate has a first axially-extending segment with a first straight radially-outward-facing surface, the inner radial portion also having a second axially-extending segment with a second straight radially-outward-facing surface and a third straight surface, which is oriented at a right angle with respect to the orientation of the first and second straight radially-outward-facing surfaces. In this embodiment, the first straight radially-inward-facing surface abuts the first and second straight radially-outward-facing surfaces, and the second straight surface abuts the third straight surface to help position the outer plate with respect to the base.

In a particular embodiment of the invention, the method includes molding the base such that the central hub portion and the perimeter portion are substantially flat, and molding the outer plate with an axially-extending inner radial portion and a radially-extending outer radial portion, where the mechanical fastener attaches the axially-extending inner radial portion to the perimeter portion.

In an alternate embodiment, the method calls for molding the outer plate such that the inner radial portion and the outer radial portion are substantially flat, and molding the base with an axially-extending perimeter portion and a radially-extending central hub portion, where the mechanical fastener attaches the axially-extending perimeter portion to the inner radial portion.

In another aspect, embodiments of the invention provide a method of manufacturing a counterweight for a scroll compressor. The method requires molding a base having an opening configured to receive a scroll compressor drive shaft, and configuring the base for assembly and attachment to the drive shaft. The method further includes molding an outer plate, and configuring the outer plate to engage a perimeter portion of the base, and attaching the outer plate to the base by brazing to form a brazing attachment, or by welding to form a welding attachment. In a particular embodiment of this method, the base and outer plate are molded from powdered metal. Attaching the outer plate to the base includes offsetting the outer plate from the base axially, with respect to the longitudinal axis of the scroll compressor drive shaft when the base is assembled to the drive shaft. In a particular embodiment, the method calls for configuring the base and the outer plate such that the perimeter portion and the inner radial portion are arcuate.

The brazing or welding attachment is located along the inner radial portion where it abuts the base perimeter portion. In a further embodiment, the brazing or welding attachment connects the axially-extending inner radial portion of the outer plate to the perimeter portion of the base. Alternatively, in certain other embodiments where the base and outer plate make possible, the brazing or welding attachment connects the axially-extending perimeter portion of the base to the inner radial portion of the outer plate. In embodiments where the attachment is formed via a welding attachment, the welding attachment may be formed by MIG welding, TIG welding, or resistance welding.

In particular embodiments of the invention, the method includes configuring the base for attachment to multiple different outer plates. Further, the method includes configuring the outer plate for removable attachment to the base. In even more particular embodiment, the removable attachment of the outer plate is accomplished via one or more mechanical fasteners.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

Figure 1:
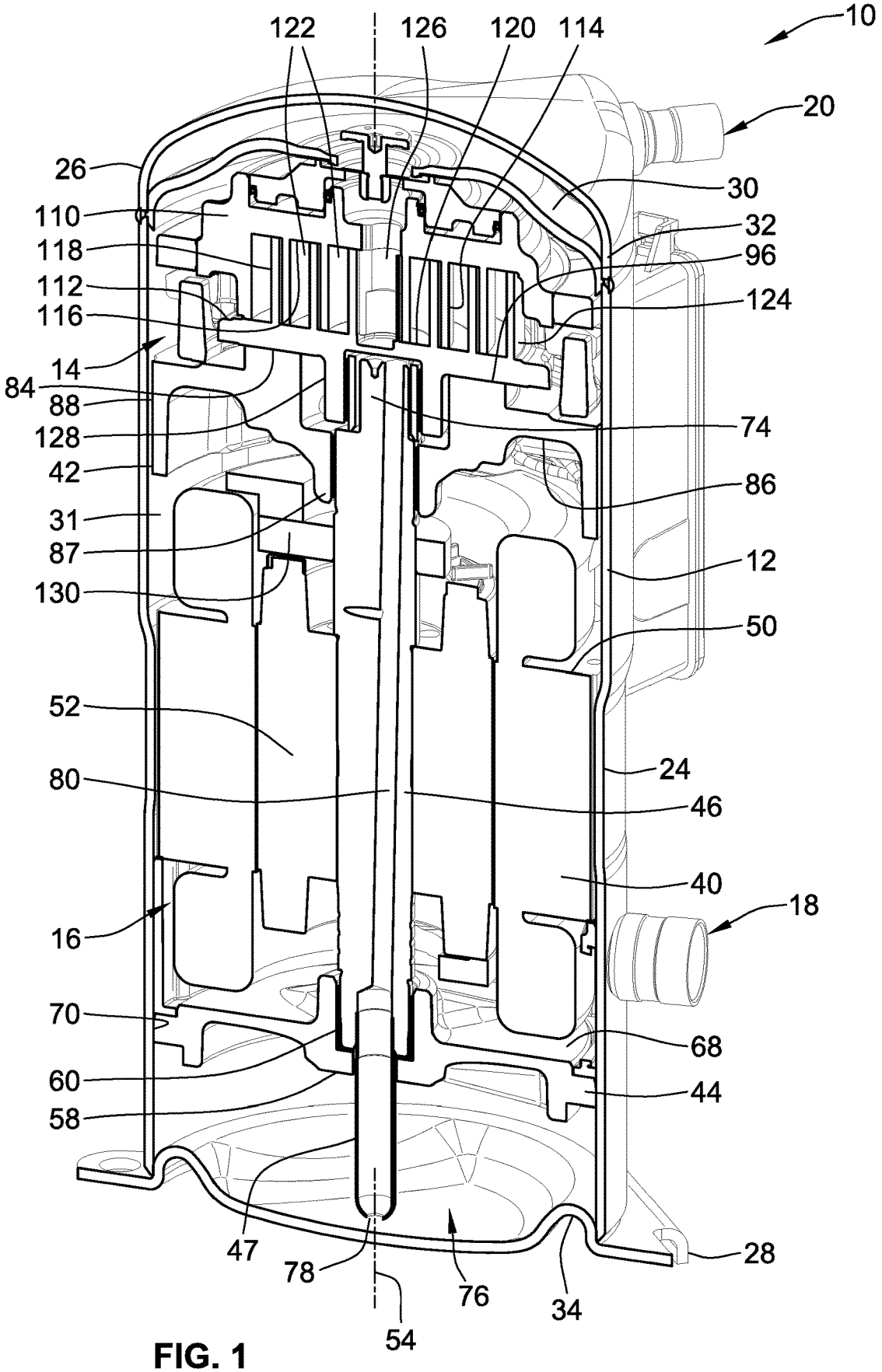
FIG. 1 is a cross-sectional isometric view of a scroll compressor assembly, according to an embodiment of the invention.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

An embodiment of the present invention is illustrated in the figures as a scroll compressor assembly 10 generally including an outer housing 12 in which a scroll compressor 14 can be driven by a drive unit 16. The scroll compressor assembly 10 may be arranged in a refrigerant circuit for refrigeration, industrial cooling, freezing, air conditioning or other appropriate applications where compressed fluid is desired. Appropriate connection ports provide for connection to a refrigeration circuit and include a refrigerant inlet port 18 and a refrigerant outlet port 20 extending through the outer housing 12. The scroll compressor assembly 10 is operable through operation of the drive unit 16 to operate the scroll compressor 14 and thereby compress an appropriate refrigerant or other fluid that enters the refrigerant inlet port 18 and exits the refrigerant outlet port 20 in a compressed high-pressure state.

The outer housing 12 for the scroll compressor assembly 10 may take many forms. In particular embodiments of the invention, the outer housing 12 includes multiple shell sections. In the embodiment of FIG. 1, the outer housing 12 includes a central cylindrical housing section 24, and a top end housing section 26, and a single-piece bottom shell 28 that serves as a mounting base. In certain embodiments, the housing sections 24, 26, 28 are formed of appropriate sheet steel and welded together to make a permanent outer housing 12 enclosure. However, if disassembly of the housing is desired, other housing assembly provisions can be made that can include metal castings or machined components, wherein the housing sections 24, 26, 28 are attached using fasteners.

As can be seen in the embodiment of FIG. 1, the central housing section 24 is cylindrical, joined with the top end housing section 26. In this embodiment, a separator plate 30 is disposed in the top end housing section 26. During assembly, these components can be assembled such that when the top end housing section 26 is joined to the central cylindrical housing section 24, a single weld around the circumference of the outer housing 12 joins the top end housing section 26, the separator plate 30, and the central cylindrical housing section 24. In particular embodiments, the central cylindrical housing section 24 is welded to the single-piece bottom shell 28, though, as stated above, alternate embodiments would include other methods of joining (e.g., fasteners) these sections of the outer housing 12.

Assembly of the outer housing 12 results in the formation of an enclosed chamber 31 that surrounds the drive unit 16, and partially surrounds the scroll compressor 14. In particular embodiments, the top end housing section 26 is generally dome-shaped and includes a respective cylindrical side wall region 32 that abuts the top of the central cylindrical housing section 24, and provides for closing off the top end of the outer housing 12. As can also be seen from FIG. 1, the bottom of the central cylindrical housing section 24 abuts a flat portion just to the outside of a raised annular rib 34 of the bottom end housing section 28. In at least one embodiment of the invention, the central cylindrical housing section 24 and bottom end housing section 28 are joined by an exterior weld around the circumference of a bottom end of the outer housing 12.

In a particular embodiment, the drive unit 16 in is the form of an electrical motor assembly 40. The electrical motor assembly 40 operably rotates and drives a shaft 46. Further, the electrical motor assembly 40 generally includes a stator 50 comprising electrical coils and a rotor 52 that is coupled to the drive shaft 46 for rotation together. The stator 50 is supported by the outer housing 12, either directly or via a spacer, or adapter. The stator 50 may be press-fit directly into outer housing 12, or may be fitted with an adapter (not shown) and press-fit into the outer housing 12. In a particular embodiment, the rotor 52 is mounted on the drive shaft 46, which is supported by upper and lower bearing members 42, 44. Energizing the stator 50 is operative to rotatably drive the rotor 52 and thereby rotate the drive shaft 46 about a central axis 54. Applicant notes that when the terms "axial" and "radial" are used herein to describe features of components or assemblies, they are defined with respect to the central axis 54 which may also be referred to as the longitudinal axis for the compressor drive shaft. Specifically, the term "axial" or "axially-extending" refers to a feature that projects or extends in a direction parallel to the central axis 54, while the terms "radial' or "radially-extending" indicates a feature that projects or extends in a direction perpendicular to the central axis 54.

With reference to FIG. 1, the lower bearing member 44 includes a central, generally cylindrical hub 58 that includes a central bushing and opening to provide a cylindrical bearing 60 to which the drive shaft 46 is journaled for rotational support. A plate-like ledge region 68 of the lower bearing member 44 projects radially outward from the central hub 58, and serves to separate a lower portion of the stator 50 from an oil lubricant sump 76. An axially-extending perimeter surface 70 of the lower bearing member 44 may engage with the inner diameter surface of the central housing section 24 to centrally locate the lower bearing member 44 and thereby maintain its position relative to the central axis 54. This can be by way of an interference and press-fit support arrangement between the lower bearing member 44 and the outer housing 12.

In the embodiment of FIG. 1, the drive shaft 46 has an impeller tube 47 attached at the bottom end of the drive shaft 46. In a particular embodiment, the impeller tube 47 is of a smaller diameter than the drive shaft 46, and is aligned concentrically with the central axis 54. As can be seen from FIG. 1, the drive shaft 46 and impeller tube 47 pass through an opening in the cylindrical hub 58 of the lower bearing member 44. At its upper end, the drive shaft 46 is journaled for rotation within the upper bearing member 42. Upper bearing member 42 may also be referred to as a "crankcase".

The drive shaft 46 further includes an offset eccentric drive section 74 that has a cylindrical drive surface 75 (shown in FIG. 2) about an offset axis that is offset relative to the central axis 54. This offset drive section 74 is journaled within a cavity of a movable scroll compressor body 112 of the scroll compressor 14 to drive the movable scroll compressor body 112 about an orbital path when the drive shaft 46 rotates about the central axis 54. To provide for lubrication of all of the various bearing surfaces, the outer housing 12 provides the oil lubricant sump 76 at the bottom end of the outer housing 12 in which suitable oil lubricant is provided. The impeller tube 47 has an oil lubricant passage and inlet port 78 formed at the end of the impeller tube 47. Together, the impeller tube 47 and inlet port 78 act as an oil pump when the drive shaft 46 is rotated, and thereby pumps oil out of the lubricant sump 76 into an internal lubricant passageway 80 defined within the drive shaft 46. During rotation of the drive shaft 46, centrifugal force acts to drive lubricant oil up through the lubricant passageway 80 against the action of gravity. The lubricant passageway 80 has various radial passages projecting therefrom to feed oil through centrifugal force to appropriate bearing surfaces and thereby lubricate sliding surfaces as may be desired.

Figure 2:
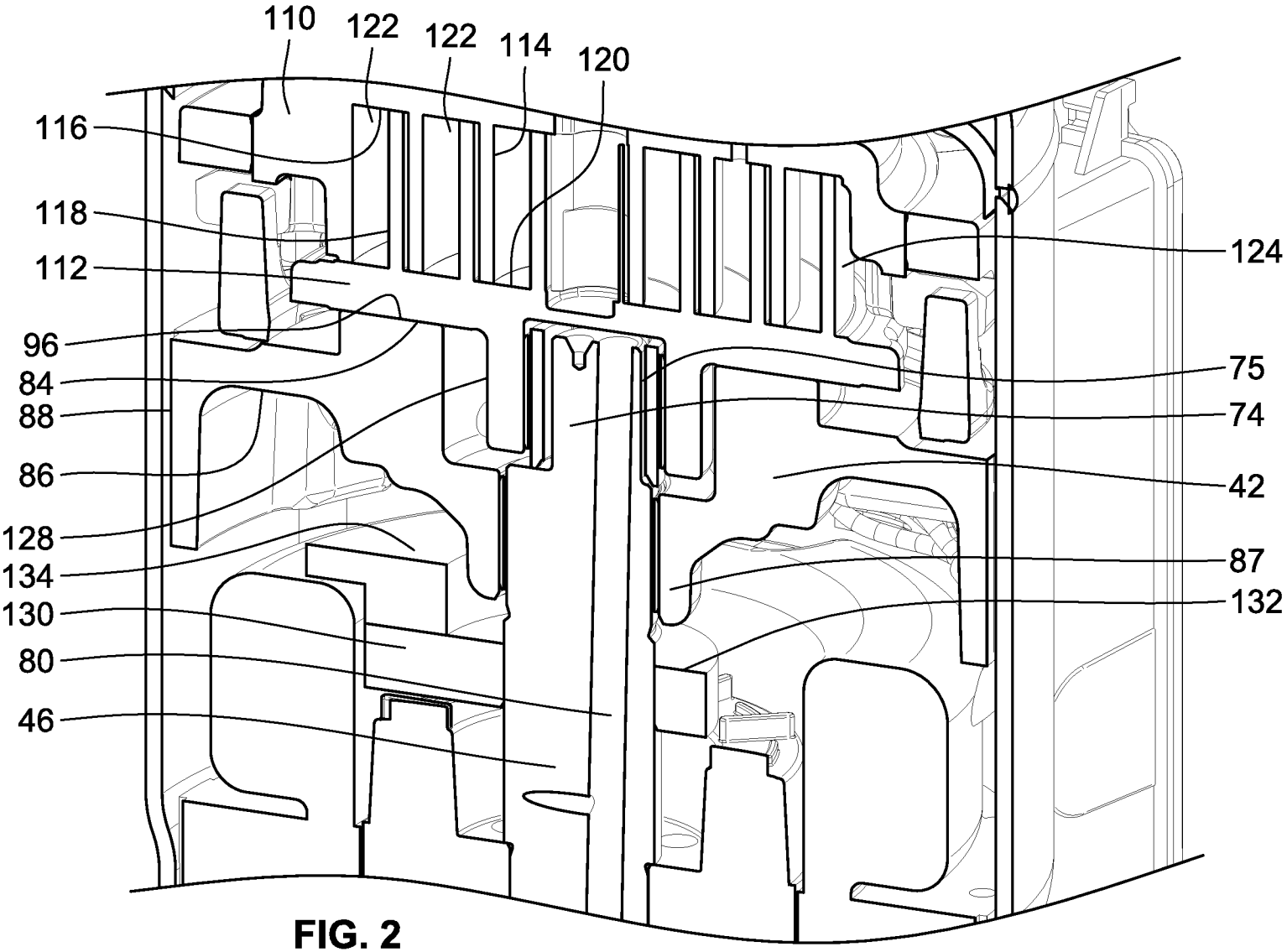
FIG. 2 is a cross-sectional isometric view of an upper portion of the scroll compressor assembly of FIG. 1.
Figure 3:
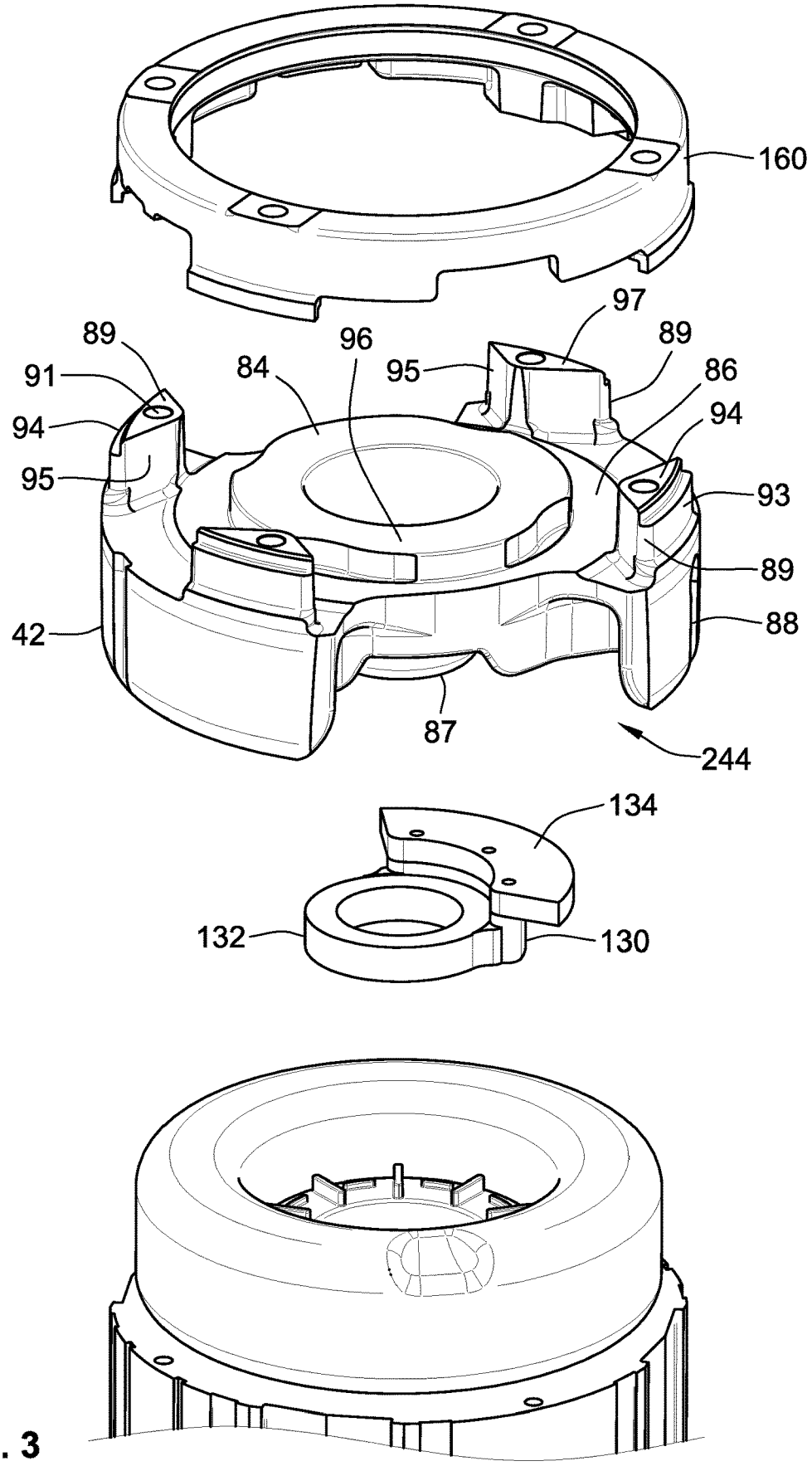
FIG. 3 is an exploded isometric view of selected components of the scroll compressor assembly of FIG. 1.

As shown in FIGS. 2 and 3, the upper bearing member, or crankcase, 42 includes a central bearing hub 87 into which the drive shaft 46 is journaled for rotation, and a thrust bearing 84 that supports the movable scroll compressor body 112. Extending outward from the central bearing hub 87 is a disk-like portion 86 that terminates in an intermittent perimeter support surface 88 defined by discretely spaced posts 89. In the embodiment of FIG. 3, the central bearing hub 87 extends below the disk-like portion 86, while the thrust bearing 84 extends above the disk-like portion 86. In certain embodiments, the intermittent perimeter support surface 88 is adapted to have an interference and press-fit with the outer housing 12. In the embodiment of FIG. 3, the crankcase 42 includes four posts 89, each post having an opening 91 configured to receive a threaded fastener. It is understood that alternate embodiments of the invention may include a crankcase with more or less than four posts, or the posts may be separate components altogether. Alternate embodiments of the invention also include those in which the posts are integral with the pilot ring instead of the crankcase.

In certain embodiments such as the one shown in FIG. 3, each post 89 has an arcuate outer surface 93 spaced radially inward from the inner surface of the outer housing 12, angled interior surfaces 95, and a generally flat top surface 97 which can support a pilot ring 160. In this embodiment, the intermittent perimeter support surface 88 abuts the inner surface of the outer housing 12. Further, each post 89 has a chamfered edge 94 on a top, outer portion of the post 89. In particular embodiments, the crankcase 42 includes a plurality of spaces 244 between adjacent posts 89. In the embodiment shown, these spaces 244 are generally concave and the portion of the crankcase 42 bounded by these spaces 244 will not contact the inner surface of the outer housing 12.

The upper bearing member or crankcase 42 also provides axial thrust support to the movable scroll compressor body 112 through a bearing support via an axial thrust surface 96 of the thrust bearing 84. While, as shown FIGS. 1-3, the crankcase 42 may be integrally provided by a single unitary component.

Turning in greater detail to the scroll compressor 14, the scroll compressor includes first and second scroll compressor bodies which preferably include a stationary fixed scroll compressor body 110 and a movable scroll compressor body 112. While the term "fixed" generally means stationary or immovable in the context of this application, more specifically "fixed" refers to the non-orbiting, non-driven scroll member, as it is acknowledged that some limited range of axial, radial, and rotational movement is possible due to thermal expansion and/or design tolerances.

The movable scroll compressor body 112 is arranged for orbital movement relative to the fixed scroll compressor body 110 for the purpose of compressing refrigerant. The fixed scroll compressor body includes a first rib 114 projecting axially from a plate-like base 116 and is designed in the form of a spiral. Similarly, the movable scroll compressor body 112 includes a second scroll rib 118 projecting axially from a plate-like base 120 and is in the shape of a similar spiral. The scroll ribs 114, 118 engage in one another and abut sealingly on the respective base surfaces 120, 116 of the other respective scroll compressor body 112, 110.

As a result, multiple compression chambers 122 are formed between the scroll ribs 114, 118 and the bases 120, 116 of the compressor bodies 112, 110. Within the chambers 122, progressive compression of refrigerant takes place. Refrigerant flows with an initial low pressure via an intake area 124 surrounding the scroll ribs 114, 118 in the outer radial region (see e.g., FIGS. 1-2). Following the progressive compression in the chambers 122 (as the chambers progressively are defined radially inward), the refrigerant exits via a compression outlet 126 which is defined centrally within the base 116 of the fixed scroll compressor body 110. Refrigerant that has been compressed to a high pressure can exit the chambers 122 via the compression outlet 126 during operation of the scroll compressor 14.

The movable scroll compressor body 112 engages the eccentric offset drive section 74 of the drive shaft 46. More specifically, the receiving portion of the movable scroll compressor body 112 includes the cylindrical bushing drive hub 128 which slideably receives the eccentric offset drive section 74 with a slideable bearing surface provided therein. In detail, the eccentric offset drive section 74 engages the cylindrical bushing drive hub 128 in order to move the movable scroll compressor body 112 about an orbital path about the central axis 54 during rotation of the drive shaft 46 about the central axis 54. Considering that this offset relationship causes a weight imbalance relative to the central axis 54, the assembly typically includes a counterweight 130 that is mounted at a fixed angular orientation to the drive shaft 46. The counterweight 130 acts to offset the weight imbalance caused by the eccentric offset drive section 74 and the movable scroll compressor body 112 that is driven about an orbital path. The counterweight 130 includes an attachment collar 132 and an offset weight region 134 (see counterweight 130 shown best in FIGS. 2 and 3) that provides for the counterweight effect and thereby balancing of the overall weight of the components rotating about the central axis 54. This provides for reduced vibration and noise of the overall assembly by internally balancing or canceling out inertial forces.

As stated above, in order to support the development of more economical and compact scroll compressor assemblies, there is a need in the art for a low-cost counterweight having a complex shape capable of fitting into tight spaces between the electric drive unit and the upper bearing member. Embodiments of the present invention described herein below disclose such low-cost counterweights in the form of two-piece counterweights molded from powdered metal.

Figure 4:
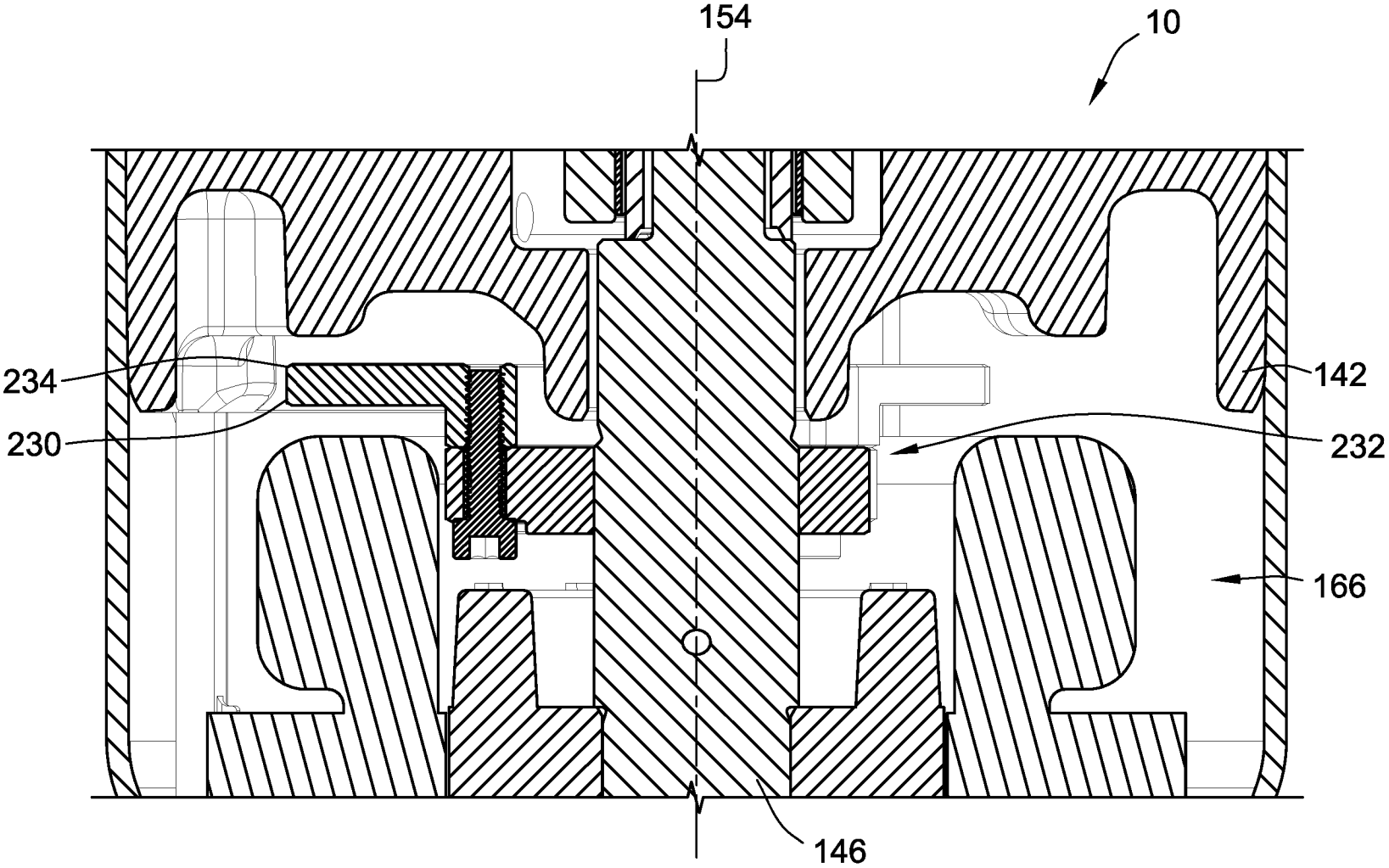
FIG. 4 is a cross-sectional view of a portion of a scroll compressor assembly, according to an embodiment of the invention.

FIG. 4 is a cross-sectional view of portion of the scroll compressor assembly 10. In accordance with an embodiment of the invention, a two-piece powdered metal counterweight 230 is assembled to a drive shaft 146 between upper bearing 142 and electric drive unit 166. The drive shaft 146 has a longitudinal axis 154. In a particular embodiment of the invention, the counterweight 230 is manufactured by molding the counterweight 230 in two pieces. As can be seen from FIG. 4, the counterweight 230 has a central portion 232 proximate the drive shaft 146, and an outer portion 234, and, in embodiments of the invention, the central and outer portions 232, 234 are separately molded pieces. The outer portion 234 is disposed radially outward, with respect to the longitudinal axis 154 of the drive shaft 146, from the center portion 232. It can also be seen from FIG. 4 that the outer portion 234 is axially offset, with respect to the longitudinal axis 154 of the drive shaft 146, from the central portion 232. In the context of the present invention, "axially offset" refers to the counterweight 230 having the central portion 232 with the bulk of its mass centered in a first axial location, and having the outer portion 234 with the bulk of it mass centered in a second axial location different from the first axial location. Alternatively, "axially offset" could be defined as the center of mass of the central portion 232 located at a first axial position, and the center of mass of the outer portion 234 located at a second axial position different from the first axial position.

Figure 5:
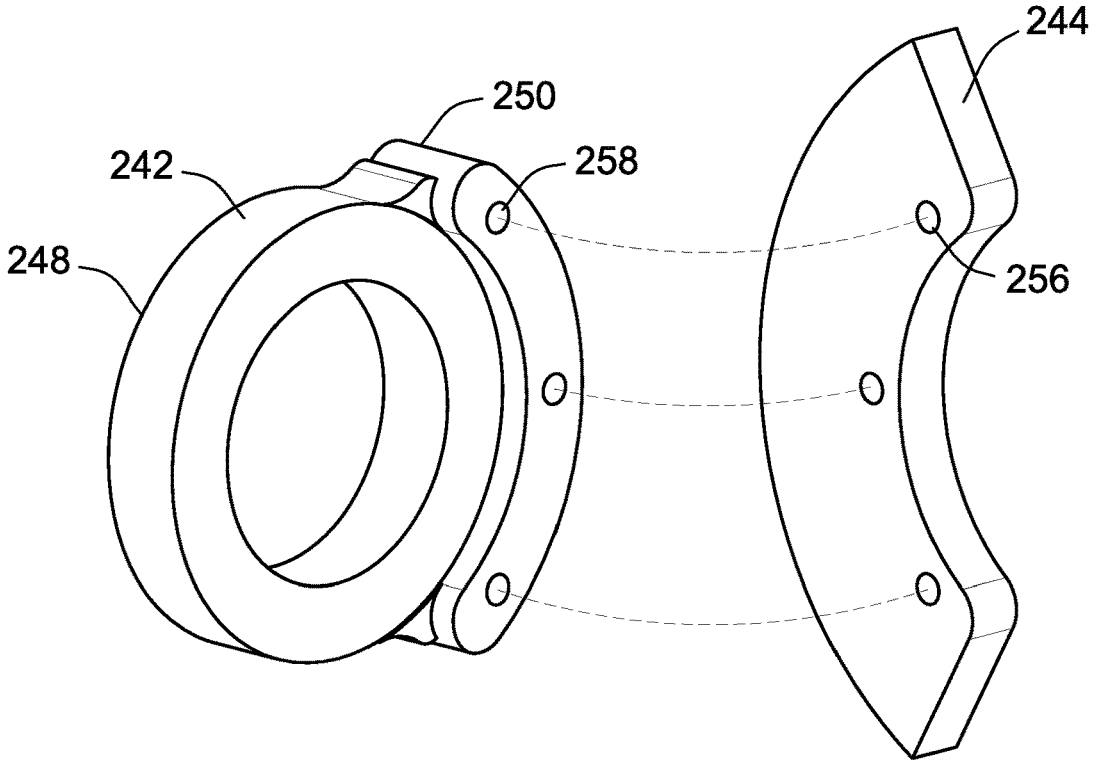
FIG. 5 is a cross-sectional view and an isometric view of a two-piece powdered metal counterweight, according to an embodiment of the invention.
Figure 5:
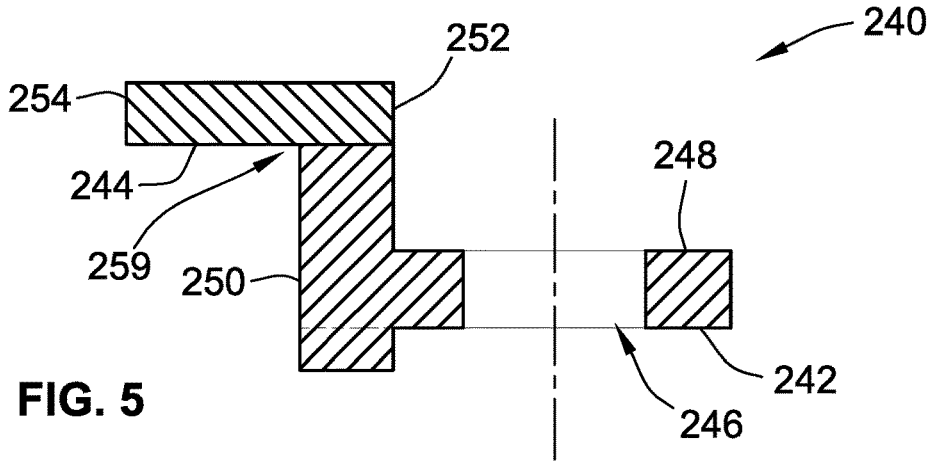
Figure 6:
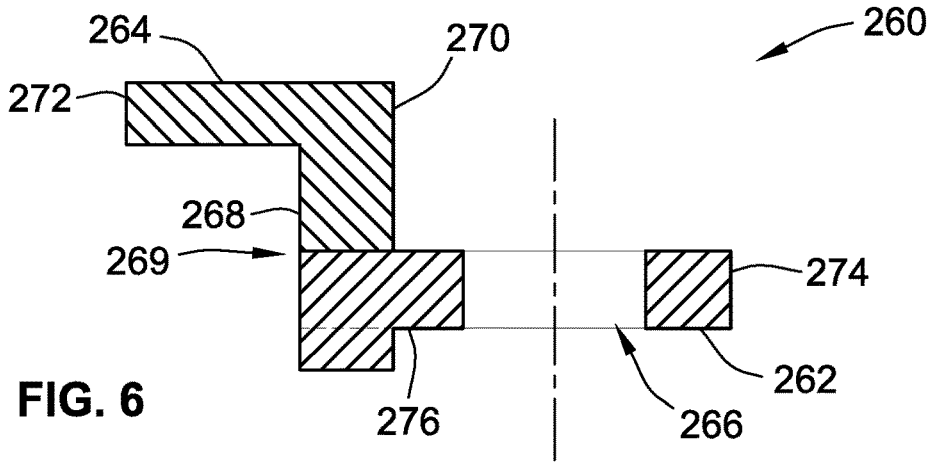
FIG. 6 is a cross-sectional view of a two-piece powdered metal counterweight, according to an alternate embodiment of the invention.

FIGS. 5 and 6 show two different embodiments of a two-piece powdered metal counterweight. FIG. 5 shows a cross-sectional view and an exploded perspective view of a counterweight 240. In FIG. 5, counterweight 240 includes a base 242 and an outer plate 244, the two components 242, 244 being separately molded from powdered metal and subsequently attached. The base has a first opening 246 configured to receive a scroll compressor drive shaft 146 (shown in FIG. 4), the base 242 serving as a point of attachment to the drive shaft 146.

In some embodiments, the base 242 has a central hub portion 248 configured to completely surround or encircle the drive shaft 146 (shown in FIG. 4), and a perimeter portion 250 located radially outward, with respect to the longitudinal axis 154 (shown in FIG. 4) of the drive shaft 146 when the base 242 is assembled to the drive shaft 146, from the central hub portion 248. The perimeter portion 250 only partially encircles the drive shaft 146, but also extends axially, with respect to the longitudinal axis 154. In FIG. 5, the perimeter portion 250 is shown extend axially upward. At the top of the axially-extending perimeter portion 250, the outer plate 244 is attached. This configuration allows the outer plate 244 to be axially offset from the base 242. In the embodiment of FIG. 5, the outer plate 244 is substantially flat extending radially outward from the base 242. More specifically, the outer plate 244 has an inner radial portion 252 and an outer radial portion 254 disposed radially outward, with respect to the longitudinal axis 154 of the drive shaft 146 when the base 242 is assembled to the drive shaft 146, from the inner radial portion 252. The inner radial portion 252 serves as the point of attachment for the outer plate 244 with respect to its attachment to the perimeter portion 250 of the base 242.

In particular embodiments of the invention, the outer plate 244 has one or more openings 256 in the inner radial portion 252, and the base 242 has one or more openings 258 in the perimeter portion 250 of the base 242. Each of the one or more openings 256 in the outer plate 244 is configured to align with the one or more openings 258 in the base 242. In these embodiments, the base 242 is attached to the outer plate 244 by inserting a mechanical fastener (not shown) through the aligned one or more openings 256, 258 in the base 242 and outer plate 244. In an alternative embodiment, the base 242 is attached to the outer plate 244 by brazing to form a brazing attachment 259. In this embodiment, the brazing attachment 259 connects the axially-extending perimeter portion 250 to the inner radial portion 252 of the outer plate 244. In some embodiments, the brazing attachment 259 is arcuate, being located along the inner radial portion 252 where it abuts a top end of the axially-extending base perimeter portion 250.

FIG. 6 shows a cross-sectional view and an exploded perspective view of a counterweight 260. In FIG. 6, counterweight 260 includes a base 262 and an outer plate 264, the two components 262, 264 being separately molded from powdered metal and subsequently attached. The base has a first opening 266 configured to receive a scroll compressor drive shaft 146 (shown in FIG. 4), the base 262 serving as a point of attachment to the drive shaft 146. The point of attachment could be a brazing attachment 269, similar to that described above in FIG. 5. In this FIG. 6 embodiment, the brazing attachment 269 connects the axially-extending inner radial portion 270 to the perimeter portion 276. As in the example above, the brazing attachment may be arcuate being located along a bottom end of the axially-extending inner radial portion 270 where it abuts the base perimeter portion 276.

The counterweight 260 is similar to the counterweight 240 of FIG. 5, except that, in FIG. 6, the outer plate 264 has an inner radial portion 270 with an axially-extending portion 268, along with an outer radial portion 272. The base 262 is substantially flat with central hub portion 274 and perimeter portion 276. In the embodiment of FIG. 6, the base 262 is substantially flat, while the outer plate 264 has the axially-extending inner radial portion 270 and the outer radial portion 272 which extends radially outward from the base 262, with respect to the longitudinal axis 154 (shown in FIG. 4). As in the embodiment above, this configuration allows the outer plate 264 to be axially offset from the base 262. The bottom of the axially-extending portion 268 abuts the perimeter portion 276 forming a point of attachment. As in the counterweight 240 of FIG. 5, the base 262 and outer plate 264 may be attached via a mechanical fastener (not shown) inserted through one or more aligned openings, as shown in FIG. 5, in the perimeter portion 276 and the inner radial portion 270.

In the embodiments of FIGS. 5 and 6, each of the one or more openings 258 in the base 242, 262 may be threaded such that mechanical fastener extends through one or more unthreaded openings 256 in the outer plate 244, 264 to the threaded openings in the base 242, 262. Alternatively, the one or more openings 256 in the outer plate 244 may be threaded, and the mechanical fastener extending through one or more unthreaded openings 258 in the base 242, 262 to the threaded openings in the outer plate 244, 264.

In each of the embodiments described above, and in those to be described below, the base may be molded to include an arcuate perimeter portion that is arcuate, and the outer plate may be molded to include an inner radial portion that is arcuate, and, in certain embodiments an outer radial portion that is also arcuate.

Figure 7:
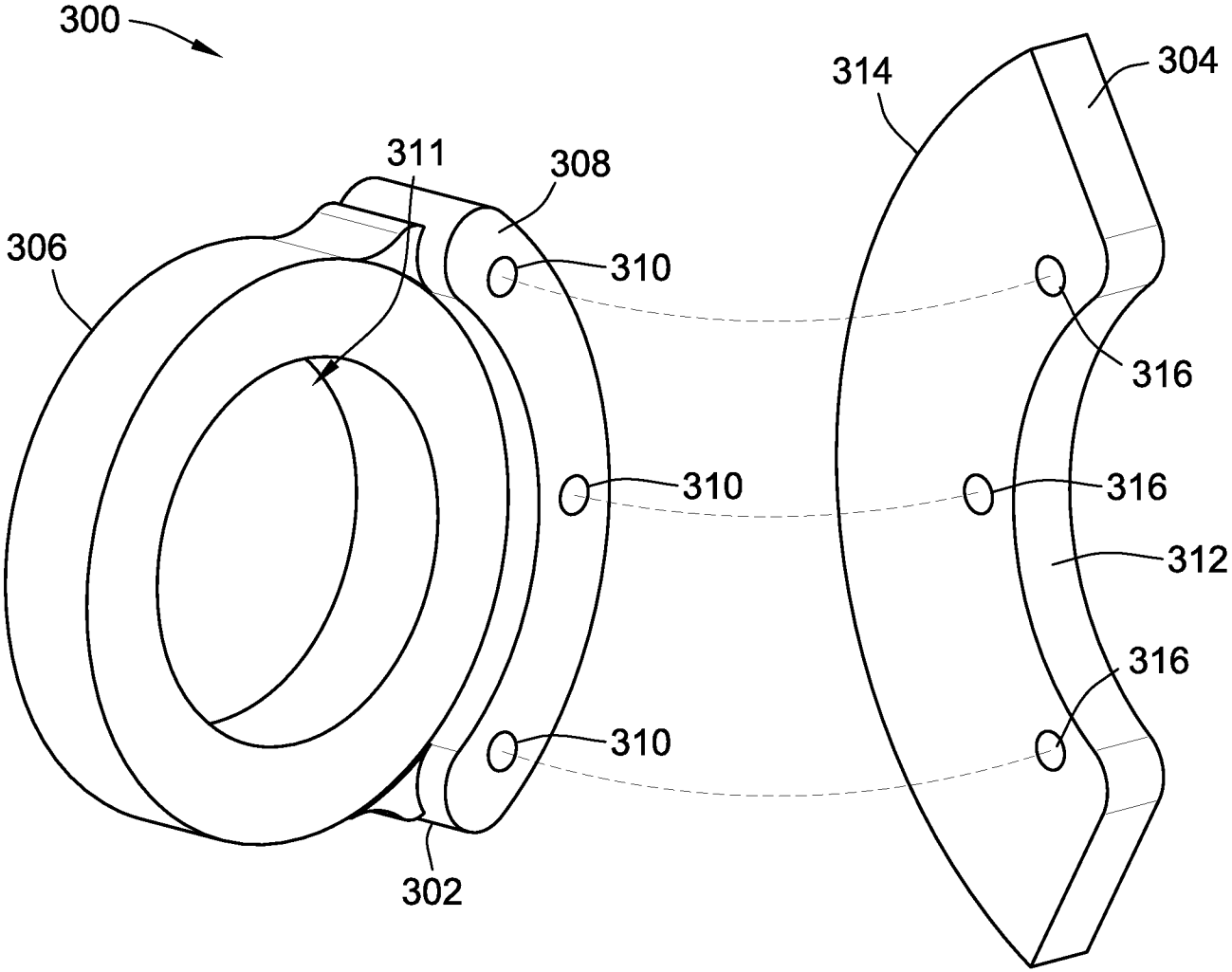
FIGS. 7-9 illustrate isometric views of two-piece powdered metal counterweights, constructed in accordance with an embodiment of the invention.
Figure 8:
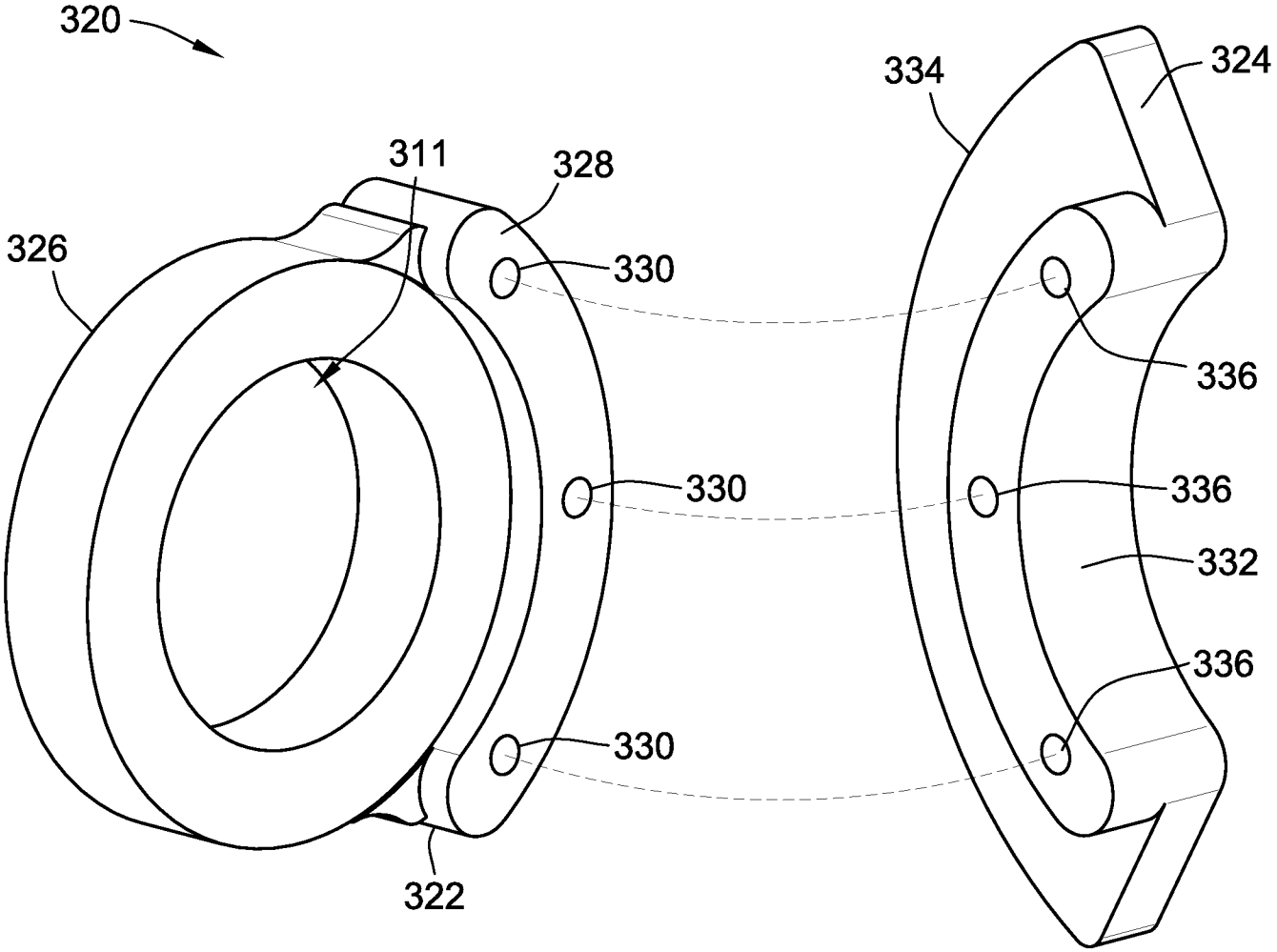
Figure 9:
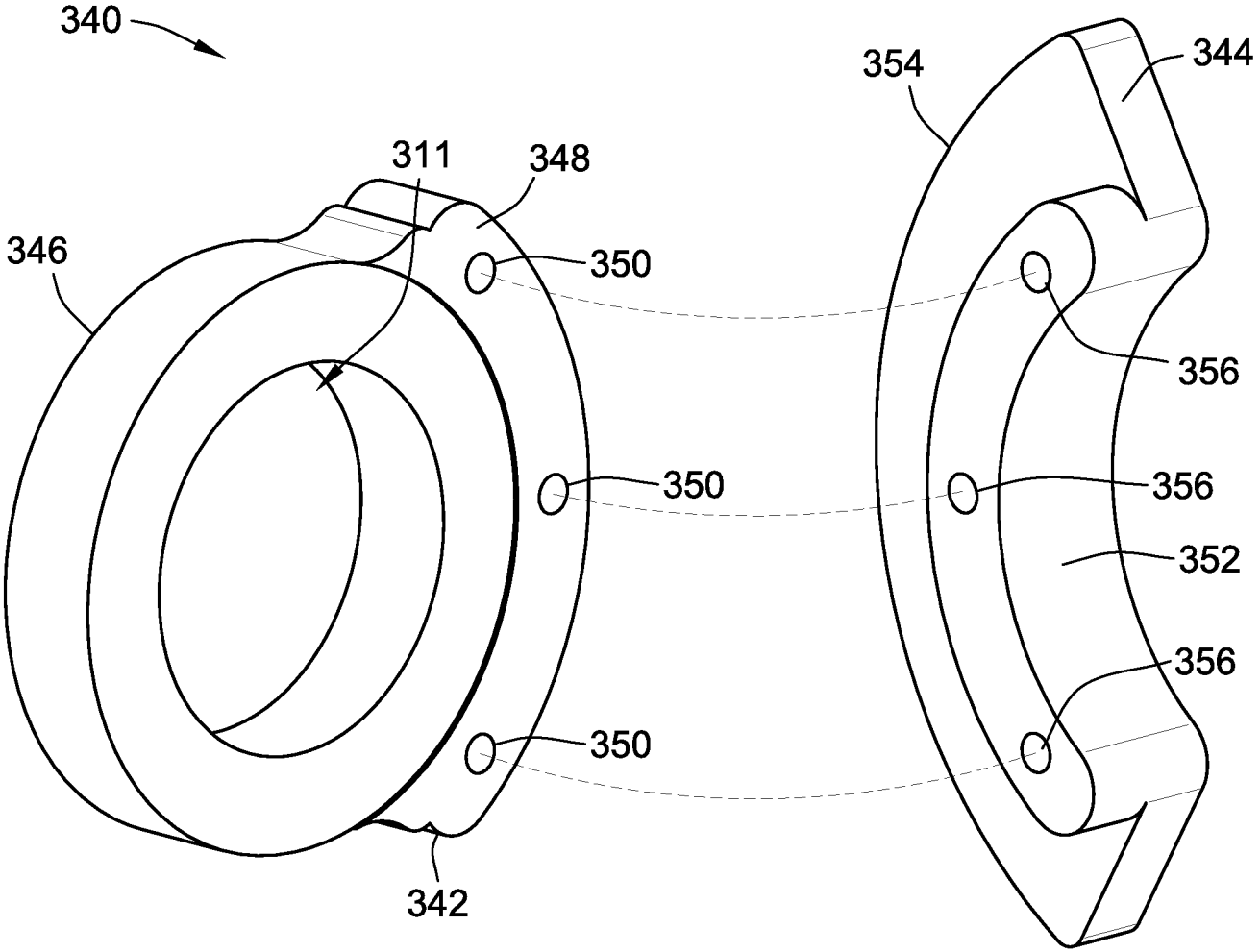

FIGS. 7-9 illustrate perspective views of alternate embodiments of the counterweight that is a subject of the present invention. FIG. 7 shows a counterweight 300 with a base 302 and an outer plate 304. The base 302 has a central hub portion 306 and a perimeter portion 308. There are one or more openings 310 located in the perimeter portion 308. In each of FIGS. 7-9, the base 302, 322, 342 also has a large central opening 311 through which the drive shaft 146 (shown in FIG. 4) is inserted during assembly. The outer plate has an inner radial portion 312 and an outer radial portion 314. There are one or more openings 316 located in the inner radial portion 312, the one or more openings 316 in the outer plate 304 configured to align with the one or more openings 310 in the base 302. While not to the same degree as the embodiments of FIGS. 5 and 6, the outer plates in the assembled counterweights, shown in FIGS. 7-9, are axially offset from the bases.

In FIG. 7, the central hub portion 306 has a first thickness while the perimeter portion 308 has a second thickness greater than the first. This is to offset the outer plate 304 axially such that in the assembled and running state, the outer plate 304 does not interfere with the stator 50 end turn winding's. In this embodiment, the outer plate 304 is of substantially uniform thickness. In alternate embodiments, manufacturing optimization may dictate that the thicker portion may be attributed to the outer plate 304 instead, and the entire base 302 may be of substantially uniform thickness.

In FIG. 8, a counterweight 320 has a base 322 and an outer plate 324. The base 322 has central hub portion 326 and perimeter portion 328 with one or more openings 330, while the outer plate 324 has inner radial portion 332 with one or more openings 336, and an outer radial portion 334. In this embodiment, the central hub portion 326 has a first thickness while the perimeter portion 328 has a second thickness greater than the first. This is to offset the outer plate 304 axially such that in the assembled and running state, the outer plate does not interfere with the stator 50 end turn winding's. However, in the outer plate 324, the inner radial portion 332 has a first thickness while the outer radial portion 334 has a second thickness. In the event that the required axial offset between the base 322 and outer plate 324 is too great to be accomplished using best practices in powder metal manufacturing, the total thickness may be split, allocating a portion of the thickness to the base 322, and the remaining required thickness to the outer plate 324.

In FIG. 9, a counterweight 340 has a base 342 and an outer plate 344. The base 342 has central hub portion 346 and perimeter portion 348 with one or more opening 350, while the outer plate 344 has inner radial portion 352 with one or more openings 356, and an outer radial portion 354. In this embodiment, the base 342 is of substantially uniform thickness. However, in the outer plate 344, the inner radial portion 352 has a first thickness while the outer radial portion 354 has a second thickness. The first thickness is greater than the second thickness to substantially offset the outer plate 344 axially such that in the assembled and running state, the outer plate 344 does not interfere with the stator 50 end turn winding's.

While each of the embodiments in FIGS. 7-9 has three openings for mechanical fasteners in both the base and outer plate, one skilled in the art will recognize that embodiments of the invention includes bases and outer plates with fewer or greater than three openings. It is envisioned that some embodiments of the invention will have one opening in the base and outer plate, while other embodiments could have five or more openings. One skilled in the art will also recognize that any of the embodiment in FIGS. 7-9, and any of the embodiments described below, could include bases and outer plates that are joined by brazing, in a fashion similar to that described above with respect to the embodiments of FIGS. 5 and 6, rather than by mechanical fasteners.

Figure 10:
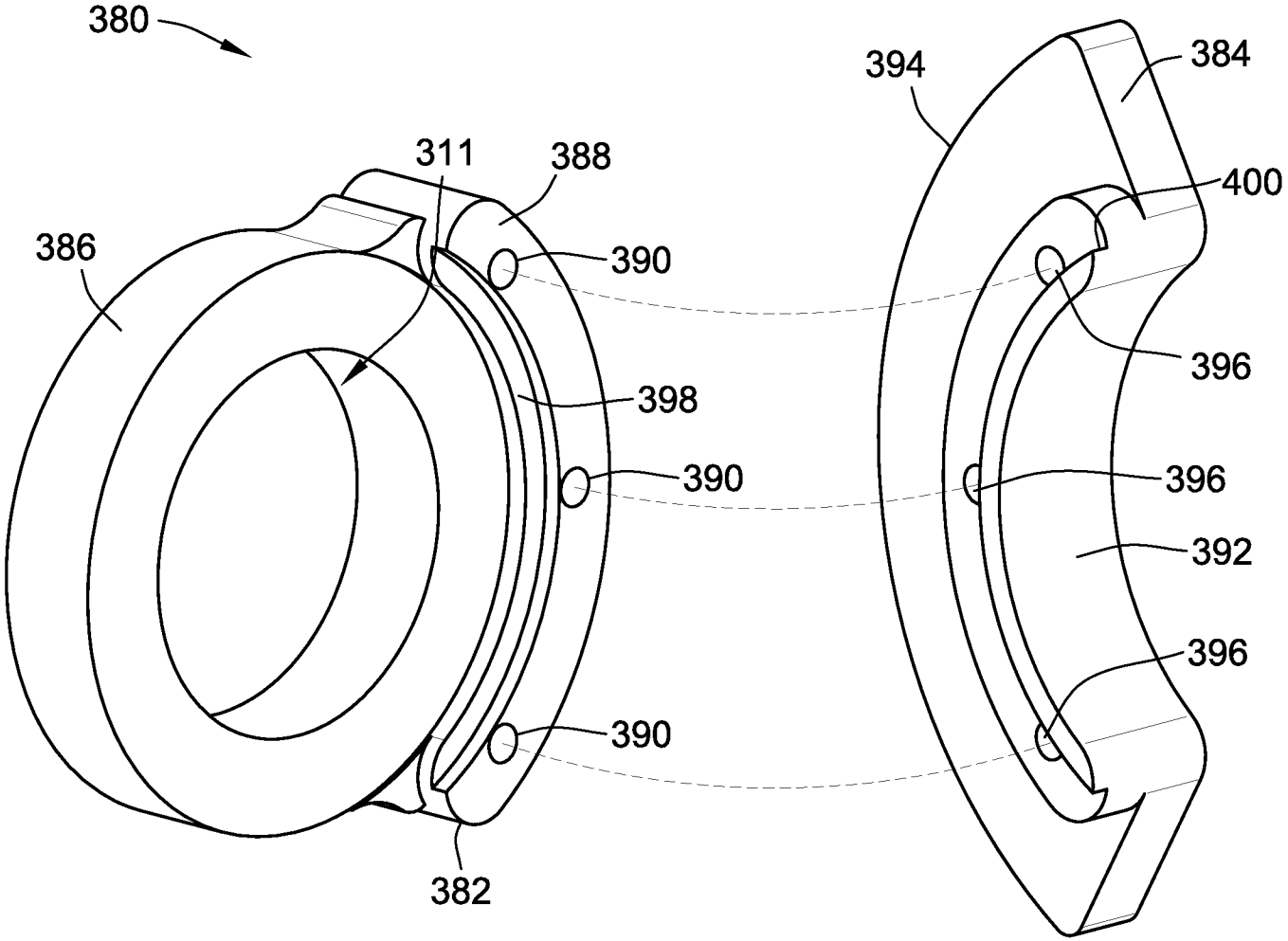
FIG. 10 is an isometric view of a two-piece powdered metal counterweight, according to yet another embodiment of the invention.

FIG. 10 is a perspective view of a counterweight 380, according to an embodiment of the invention. In FIG. 10, the counterweight 380 has a base 382 and an outer plate 384. The base 382 has central hub portion 386 and perimeter portion 388 with one or more openings 390, while the outer plate 384 has inner radial portion 392 with one or more openings 396, and an outer radial portion 394. In this embodiment, the central hub portion 386 has a first thickness while the perimeter portion 388 has a second thickness greater than the first. This is to offset the outer plate 384 axially such that in the assembled and running state, the outer plate 384 does not interfere with the stator 50 end turn winding's. The thicker perimeter portion 388 also includes a step 398. In the embodiment of FIG. 10, the step 398 is positioned proximate the interface of the central hub portion 386 and the perimeter portion 388.

However, the outer plate 384 is of substantially uniform thickness. But, as shown in the embodiment of FIG. 10, the inner radial portion 392 has an axially-extending stepped portion 400 which adds some thickness to a small portion of the outer plate 384. The axially-extending stepped portion 400 is configured to fit within the base step 398. By nesting stepped portion 400 in the step 398, these components absorb some of the centrifugal force generated as the counterweight 380 spins around the drive shaft 146 (shown in FIG. 4) and helps position the outer plate 384 with respect to the base 382. In particular embodiments, such as FIG. 10, the stepped portion 400 and the step 398 are both arcuate.

Figure 11:
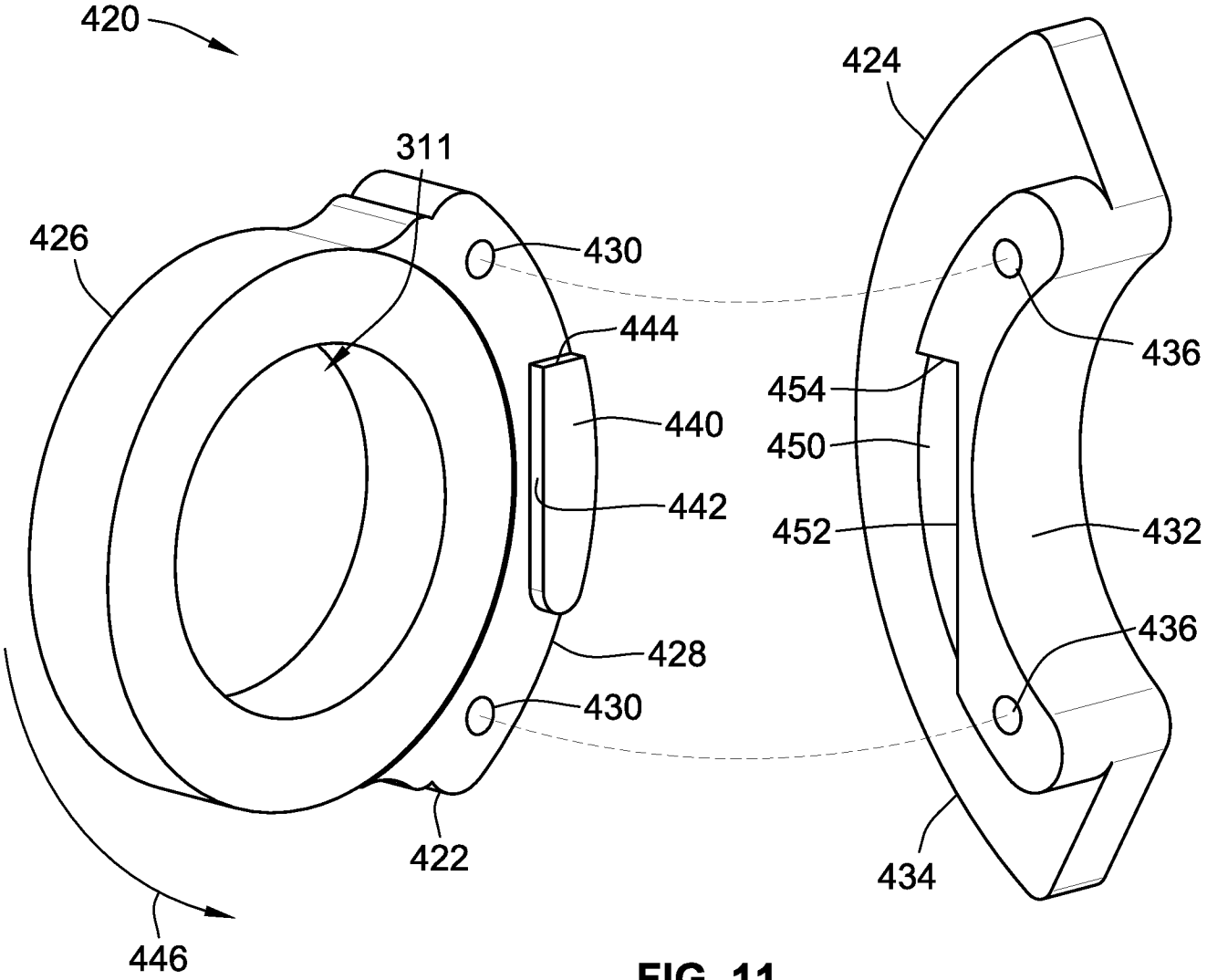
FIG. 11 is an isometric view of a two-piece powdered metal counterweight, according to an alternate embodiment of the invention.

FIG. 11 is a perspective view of a counterweight 420, according to yet another embodiment of the invention. In FIG. 11, the counterweight 420 has a base 422 and an outer plate 424. The base 422 has central hub portion 426 and perimeter portion 428 with one or more openings 430, while the outer plate 424 has inner radial portion 432 with one or more openings 436, and an outer radial portion 434. In this embodiment, the base 422 is of a substantially uniform thickness. In the outer plate 424, the inner radial portion 432 has a first thickness, while the outer radial portion 434 has a second thickness. The first thickness is greater than the second thickness.

The perimeter portion 428 of base 422 includes an axially-extending stepped segment 440 with a first straight radially-inward-facing surface 442. The terms "radially inward" and "radially outward" are used with respect to the longitudinal axis 154 of the drive shaft 146 (shown in FIG. 4) when the counterweight 420 is assembled to the drive shaft 146. Though not required, in particular embodiments, the stepped segment 440 further includes a base second straight surface 444 perpendicular to the first straight radially-inward-facing surface 442. In the embodiment shown, the base second straight surface 444 faces the direction of rotation for the counterweight 420, shown by arrow 446.

The outer plate 424 has a notched segment 450 with a first straight radially-outward-facing surface 452. The first straight radially-outward-facing surface 452 is configured to abut the first straight radially-inward-facing surface 442 on the base 422 to help position the outer plate 424 with respect to the base 422. The notched segment 450 also includes an outer plate second straight surface 454 perpendicular to the first straight radially-outward-facing surface 452. When attached to the base 422, the outer plate second straight surface 454 faces opposite the direction of rotation for the counterweight 420, shown by arrow 446, and is configured to abut the base second straight surface 444 to help position the outer plate 424 with respect to the base 422. Further, the interface of the first straight radially-inward-facing surface 442 with the first straight radially-outward-facing surface 452, and the interface of the base second straight surface 444 with the outer plate second straight surface 454, absorbs some of the centrifugal force generated as the counterweight 420 spins around the drive shaft 146 (shown in FIG. 4), and some of the rotational force imparted by the electric motor 40, respectively.

Figure 12:
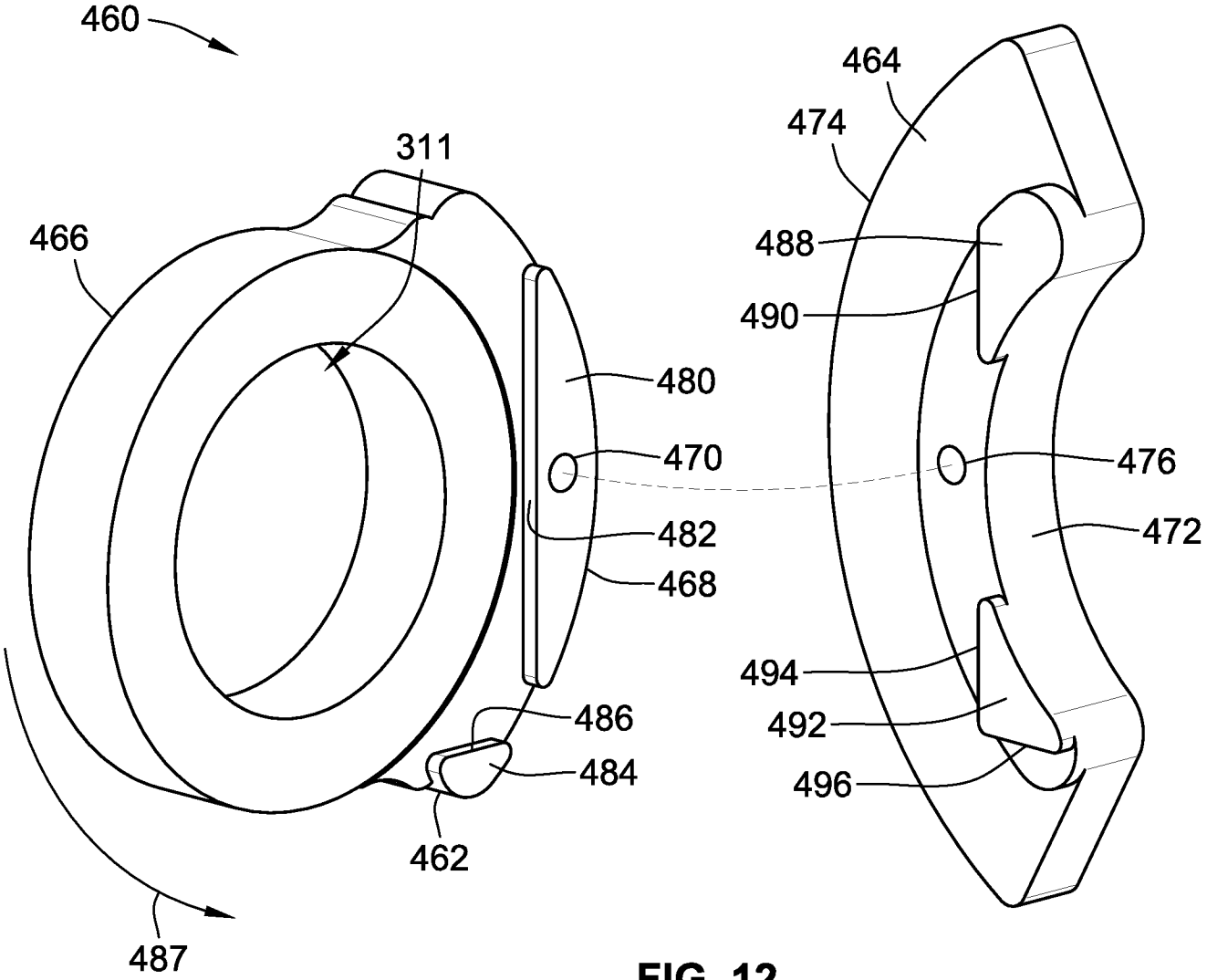
FIG. 12 is an isometric view of a two-piece powdered metal counterweight, according to yet another embodiment of the invention.

FIG. 12 is a perspective view of a counterweight 460, according to yet another embodiment of the invention. In FIG. 121, a counterweight 460 has a base 462 and an outer plate 464. The base 462 has central hub portion 466 and perimeter portion 468 with one or more openings 470, while the outer plate 464 has inner radial portion 472 with one or more openings 476, and an outer radial portion 474. In this embodiment, the base 462 is of a substantially uniform thickness. In the outer plate 464, the inner radial portion 472 has a first thickness, while the outer radial portion 474 has a second thickness. The first thickness is greater than the second thickness.

The perimeter portion 468 of base 462 includes a first axially-extending stepped segment 480 with a first straight radially-inward-facing surface 482. The terms "radially inward" and "radially outward" are used with respect to the longitudinal axis 154 of the drive shaft 146 (shown in FIG. 4) when the counterweight 460 is assembled to the drive shaft 146. In the particular embodiment shown in FIG. 12, the base 462 includes a second axially-extending stepped segment 484 with a base second straight surface 486 perpendicular to the first straight radially-inward-facing surface 482. In the embodiment shown, the base second straight surface 486 faces the direction of rotation for the counterweight 460, shown by arrow 487.

The inner radial portion 472 of the outer plate 464 has a first axially-extending segment 488 with a first straight radially-outward-facing surface 490. The inner radial portion 472 also includes a second axially-extending segment 492 with a second straight radially-outward-facing surface 494 and a third straight surface 496. The third straight surface 496 is perpendicular to the first and second straight radially-outward-facing surfaces 490, 494. When the outer plate 464 is attached to the base 462, the third straight surface 496 faces opposite the direction of rotation for the counterweight 460, shown by arrow 487.

The first and second straight radially-outward-facing surfaces 490, 494 are configured to abut the first straight radially-inward-facing surface 482 on the base 462 to help position the outer plate 464 with respect to the base 462. The third straight surface 496 of the outer plate 464 is configured to abut the base second straight surface 486 to help position the outer plate 464 with respect to the base 462. Furthermore, the interface of the first and second straight radially-outward-facing surfaces 490, 494 with the first straight radially-inward-facing surface 482, and the interface of the base second straight surface 486 with the third straight surface 496, absorbs some of the centrifugal force generated as the counterweight 460 spins around the drive shaft 146 (shown in FIG. 4).

The embodiments of the two-piece counterweight described above provide a low-cost solution to the design problem of fitting a top balance counterweight into a tight space at the top of a scroll compressor drive unit. Specifically, the above-described embodiments allow for the design of a balance counterweight that attaches to a scroll compressor drive shaft inside the end turns of an electric-motor stator, where the two-piece counterweight contains a flanged portion that protrudes axially above the end turns of the stators and radially outward from the drive shaft.

The two-piece construction is preferable because, a single-piece design is typically not moldable in powdered metal without a significant amount of machining to remove unwanted material. Moreover, a single-piece design made from a casting would also require a significant amount of machining in order to meet the high tolerances within a compact scroll compressor. The two-piece powdered metal design disclosed herein is capable of meeting the necessary design tolerances with minimal machining.

It is also envisioned that the scope of the invention disclosed herein includes embodiments in which the molded base is configured to be attached to multiple different outer plates. More specifically, it is envisioned that any of the molded bases described above could be configured for the removable attachment of different outer plates. Thus, one could use the aforementioned base on a variety of different compressor models, assuming the size of the drive shaft is consistent among these different models. However, other dimensional characteristics for the compressor assembly may be different. For example, the axial distance between the top of the stator and the attachment point of the base to the drive shaft may vary between compressor models. Similarly, the radial distance between the drive shaft and compressor housing may vary between compressor models. Thus each compressor model may require a uniquely-shaped outer plate, while still accommodating a common base. In this manner, a variety of different outer plates could be attached, via mechanical fasteners or other suitable means, to a common base to form a counterweight usable in a variety of different compressor models.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A method of manufacturing a two-piece counterweight for a scroll compressor, the method comprising:

molding an outer plate;

molding a base separately from the molding of the outer plate, the base having a first opening configured to receive a scroll compressor drive shaft having a longitudinal axis, and configuring the base for assembly and attachment to the drive shaft;

attaching the outer plate to the base, wherein the outer plate is axially offset from the base, with respect to the longitudinal axis; and configuring the outer plate for removable attachment to the base;

wherein molding the base comprises molding the base having:

a central hub portion configured to completely encircle the drive shaft;

a perimeter portion located radially outward from the central hub portion with respect to the longitudinal axis, the perimeter portion only partially encircling the drive shaft; and a first axially-extending step with a first radially-inward facing surface;

wherein molding the outer plate comprises molding the outer plate with a second axially-extending step with a second radially-outward facing surface that abuts the first radially-inward facing surface to locate the outer plate with respect to the base, and to absorb some of the centrifugal force generated when the attached base and outer plate spin with the rotating drive shaft.

2. The method of claim 1, wherein the step of molding the outer plate comprises molding a powdered metal outer plate, and wherein the step of molding the base comprises molding a powdered metal base.

3. The method of claim 1, wherein the step of molding the base comprises molding the base with the first axially-extending step on the perimeter portion.

4. The method of claim 1, wherein the first axially-extending step and the second axially-extending step are arcuate.

5. The method of claim 1, wherein the first axially-extending step and the second axially-extending step are straight.

6. The method of claim 1, wherein each of the first axially-extending step and the second axially-extending step includes two angled portions.

7. The method of claim 6, wherein each of the two angled portions are perpendicular to each other.

8. The method of claim 1, wherein the step of molding the base comprises molding the perimeter portion with a first axial thickness, and molding the central hub portion with a second axial thickness that is less than the first axial thickness such that the first axially-extending step is at an interface of the perimeter portion and central hub portion.

9. The method of claim 8, wherein the step of molding the outer plate comprises molding an inner radial portion of the outer plate, where it abuts the base perimeter portion, with a third axial thickness, and molding an outer radial portion with a fourth axial thickness that is less than the third axial thickness such that the second axially-extending step is at an interface of the perimeter portion and central hub portion.

10. The method of claim 1, further comprising configuring the base for attachment to the outer plate, wherein multiple different embodiments of the outer plate are attachable to the base.

11. The method of claim 1, wherein configuring the outer plate for removable attachment comprises configuring the outer plate for removable attachment to the base via one or more mechanical fasteners.

12. The method of claim 11, wherein molding the base comprises molding the base with one or more openings located in the perimeter portion, and wherein molding the outer plate comprises molding the outer plate with one or more outer plate openings located in an inner radial portion of the outer plate, which abuts the base perimeter portion, wherein each of the one or more base openings is aligned with the one or more outer plate openings, and wherein attaching the outer plate to the base comprises inserting the one or more mechanical fasteners through each of the aligned one or more openings in the base and outer plate.

13. A method of manufacturing a two-piece counterweight for a scroll compressor, the method comprising:

molding an outer plate;

molding a base separately from the molding of the outer plate, the base having a first opening configured to receive a scroll compressor drive shaft having a longitudinal axis, and configuring the base for assembly and attachment to the drive shaft;

attaching the outer plate to the base, wherein the outer plate is axially offset from the base, with respect to the longitudinal axis;

wherein the step of molding the base comprises molding the base having:

a central hub portion configured to completely encircle the drive shaft;

a perimeter portion located radially outward from the central hub portion with respect to the longitudinal axis, the perimeter portion only partially encircling the drive shaft; and a first axially-extending step with a first radially-inward facing surface;

wherein the step of molding the outer plate comprises molding the outer plate with a second axially-extending step with a second radially-outward facing surface that abuts the first radially-inward facing surface to locate the outer plate with respect to the base, and to absorb some of the centrifugal force generated when the attached base and outer plate spin with the rotating drive shaft;

wherein molding the outer plate comprises molding the outer plate with an inner radial portion, and with an outer radial portion disposed radially outward from the inner radial portion, wherein the second axially-extending step is on the inner radial portion.

14. A method of manufacturing a two-piece counterweight for a scroll compressor, the method comprising:

molding an outer plate;

molding a base separately from the molding of the outer plate, the base having a first opening configured to receive a scroll compressor drive shaft having a longitudinal axis, and configuring the base for assembly and attachment to the drive shaft;

attaching the outer plate to the base, wherein the outer plate is axially offset from the base, with respect to the longitudinal axis;

wherein the step of molding the base comprises molding the base having:

a central hub portion configured to completely encircle the drive shaft;

a perimeter portion located radially outward from the central hub portion with respect to the longitudinal axis, the perimeter portion only partially encircling the drive shaft; and a first axially-extending step with a first radially-inward facing surface;

wherein the step of molding the outer plate comprises molding the outer plate with a second axially-extending step with a second radially-outward facing surface that abuts the first radially-inward facing surface to locate the outer plate with respect to the base, and to absorb some of the centrifugal force generated when the attached base and outer plate spin with the rotating drive shaft;

wherein the step of attaching the outer plate to the base comprises attaching the outer plate to the base by brazing to form a brazing attachment, or by welding to form a welding attachment.

15. The method of claim 14, wherein attaching the outer plate to the base comprises attaching the outer plate to the base by one of MIG welding, TIG, welding, and resistance welding.

16. The method of claim 14, wherein the welding attachment or brazing attachment is located along the base perimeter portion, and along an inner radial portion, of the outer plate where it abuts the base perimeter portion.

* * * * *